US006412224B1

(12) United States Patent
Feucht et al.

(10) Patent No.: US 6,412,224 B1
(45) Date of Patent: Jul. 2, 2002

(54) DOOR DRIVE SYSTEM

(75) Inventors: Rudi Feucht, Weissach; Ralf Hala, Lindenberg; Uwe Käser, Wiernsheim; Theo Reuff, Sindelfingen, all of (DE)

(73) Assignee: GEZE GmbH & Co., Leonberg (DE)

( * ) Notice: Subject to any disclaimer, the term of this patent is extended or adjusted under 35 U.S.C. 154(b) by 0 days.

(21) Appl. No.: 09/463,756

(22) PCT Filed: Jun. 30, 1998

(86) PCT No.: PCT/DE98/01795

§ 371 (c)(1),
(2), (4) Date: Apr. 18, 2000

(87) PCT Pub. No.: WO99/06659

PCT Pub. Date: Feb. 11, 1999

(30) Foreign Application Priority Data

Aug. 1, 1997 (DE) ..... 197 33 392
May 19, 1998 (DE) ..... 198 22 498

(51) Int. Cl.[7] ..... E05F 15/10
(52) U.S. Cl. ..... 49/340; 9/333
(58) Field of Search ..... 49/333, 334, 340, 49/341

(56) References Cited

U.S. PATENT DOCUMENTS 4,580,365 A * 4/1986 Sieg ..... 49/336
4,660,324 A * 4/1987 Nyenbrink ..... 49/340
4,847,946 A 7/1989 Nam et al. ..... 16/53
5,121,686 A 6/1992 Schonlau et al. ..... 92/163
5,353,690 A * 10/1994 Shin ..... 92/86
5,386,885 A * 2/1995 Bunzi et al. ..... 185/40 R
5,513,467 A * 5/1996 Current et al. ..... 49/340
5,687,507 A * 11/1997 Beran ..... 49/340
5,771,635 A * 6/1998 Skinner ..... 49/25
5,862,630 A * 1/1999 Krumhauer et al. ..... 49/341

FOREIGN PATENT DOCUMENTS

| | | |
|---|---|---|
| DE | 36 38 353 | 10/1987 |
| DE | 41 24 282 | 1/1993 |
| DE | 195 29 168 | 2/1996 |
| EP | 0 328 912 | 8/1989 |

* cited by examiner

*Primary Examiner*—Curtis A Cohen
(74) *Attorney, Agent, or Firm*—Crowell & Moring, LLP

(57) ABSTRACT

The invention relates to a door drive system for a wing of a door, a window or similar, comprising a housing with a drive and/or return device, e.g. a closing spring (7), and a preferably hydraulic damping device. In practice, drive housings of this type are cast in aluminium. The production costs are relatively high since housing openings and boreholes such as hydraulic channels have to be cut into the housing (31) later on. According to the invention, the housing (31) is produced wholly or partly from plastic. This enables the cavities which are necessary for the housing to function, such as housing boreholes and/or openings to be made in the drive housing when it is produced, without removing material by cutting. According to another design, the drive housing has several housing parts which are produced separately. The adjacent sections of the housing parts are then stuck or welded together. Housing boreholes such as hydraulic channels can be made in the adjacent surfaces of the housing parts which are shaped accordingly, without removing material by cutting.

39 Claims, 7 Drawing Sheets

DOOR DRIVE SYSTEM

BACKGROUND AND SUMMARY OF THE INVENTION

The invention relates to a door closer and to a method for the manufacture of a door closer.

Door closers are known which have closing springs as energy accumulators and a hydraulically damped closing movement, in which the closing spring cooperates with a hydraulic piston-and-cylinder unit. The piston-and-cylinder unit and the closing spring are disposed in a metal housing and cooperate through a rack and pinion or through a cam disk drive with a closer shaft journaled in the housing, which is connected directly or through a force-transmitting articulation to the door. When the door is opened manually the energy accumulator is charged and afterward discharged again in the automatic closing of the door. Upon each opening and closing movement of the door, the action of the piston causes hydraulic medium to be exchanged between the two piston working chambers through hydraulic passages disposed within the housing. A door closer of such construction is disclosed, for example, in EP 328 912 B1 or DE 38 353 A1.

Such door closers are known in practice in various versions. There are kinds which are mounted flat on the door or on the frame, and kinds which are integrated in the door frame. Scissor articulations or sliding arm articulations are used as the force-transmitting articulations. The housing of the door closer is made in practice of cast aluminum or from aluminum extrusions. The cost of manufacture is relatively high on account of the necessary machining. The hydraulic passages must be bored into the housing and the cylinder chamber must also be machine-finished in order to assure a precise seating of the piston.

DE 195 29 168 A1 describes a hydraulic door closer which consists of an elongated one-piece housing. The housing can be made of metal or also from polymer materials, and has a cylindrical longitudinal bore to accommodate the piston and a cross bore to accommodate the closing shaft. The exchange of the hydraulic medium takes place through a valve which is disposed in the housing cover and extends axially into the piston chamber and at the same time plunges into an axial bore in the piston. The housing itself does not have any hydraulic passages.

The invention is addressed to the problem of developing a housing for a door closer which will be easy to manufacture and machine, as well as developing a method for its manufacture.

The problem is solved according to the invention by the use of fiber-reinforced, preferably glass fiber- or carbon fiber-reinforced plastic offers special advantages in regard to strength and fashioning. Finish machining can be reduced or entirely eliminated. Also, advantageous friction properties are achieved by the use of a suitable combination of materials. Also, coatings and overlays of plastic on the housing interior wall, e.g., on the cylinder's interior wall, or also on the outside wall of the piston can be provided advantageously, and plastic coating on metal walls or on sandwich materials is possible.

By the use of suitable combination of materials, e.g., valves and valve seats in the housing, the desired temperature-independence of the valve adjustment can be obtained by appropriate temperature compensation of the materials. A combination of different plastics as well as a combination of metal and plastic can be used.

Special advantages are obtained if the plastic material is dyed to the final color of the door closers, so as to eliminate the need to lacquer or otherwise finish-coat the closer to the final color or to simplify separate external coloring operations.

In the door closer housing, bore chambers, e.g., a passage in the housing, a mounting bore and/or space to accommodate an output member, a damping piston, a closing spring, a closing motor or a valve can be already formed in the door closer housing, at least section-wise, without machining, when the housing is formed, or at least it can be preformed without machining operations. Alternatively, or additionally, the formation of at least one bore chamber is performed during the assembly of several separately made housing parts, the bore chamber being created without machining in the contacting surfaces of the housing parts or at least being preformed without cutting operations.

Since such bored chambers are formed while the door closer housing is being made by an appropriate injection mold when the door closer housing is produced, the manufacturing cost is considerably reduced. As a rule, no further machining operations are necessary. The housing is at least partially, but more advantageously entirely manufactured from plastic. Manufacture is performed, for example, by the injection molding method. This method also makes it possible in a single manufacturing process to install, for example, a shaft bearing for the output shaft by the two-component method.

Furthermore, it is possible by using plastic to produce the door closer housing from a plurality of separate housing parts and simply glue or weld them together. The cylinder chamber can be closed after installation of the piston and closing spring by means of an end plug which is welded onto the cylinder chamber. It is therefore not necessary to form a screw thread in the cylinder chamber or on the plug.

Alternatively, the cylinder chamber can be closed by an end cap cupped around the cylinder chamber while hydraulic passages are formed with its marginal sections.

In the door closer housing, recesses can be created for separately made insert parts which are welded or cemented into the recesses. At the same time, passage sections of the damping device can be formed or preformed in the confronting faces of the door closer housing and of the insert. This method is especially suited for the formation of longitudinal passages which are brought out at the end of the housing for the insertion of the hydraulic valves. The radial passages connecting the longitudinal passages to the cylinder chamber are preferably already formed in the housing during production of the latter, without machining.

In another embodiment the door closer housing is made from two halves, in which the longitudinal halves of the cylinder chamber are formed. At the same time channels or channel sections of the door closer can be formed in confronting surfaces of the housing halves.

In another embodiment of the invention it is possible to make the piston and in some cases the output shaft wholly or partially of plastic, preferably however from a plastic-metal composite material. In that case the basic body of the piston is made from plastic, while recesses for sealing rings as well as passages for check valves can be already formed. Then a rack made of metal is placed or cemented into a corresponding recess in the piston.

BRIEF DESCRIPTION OF THE DRAWINGS

The invention is further explained in the drawings, wherein.

DETAILED DESCRIPTION OF THE DRAWINGS

Figure 1:
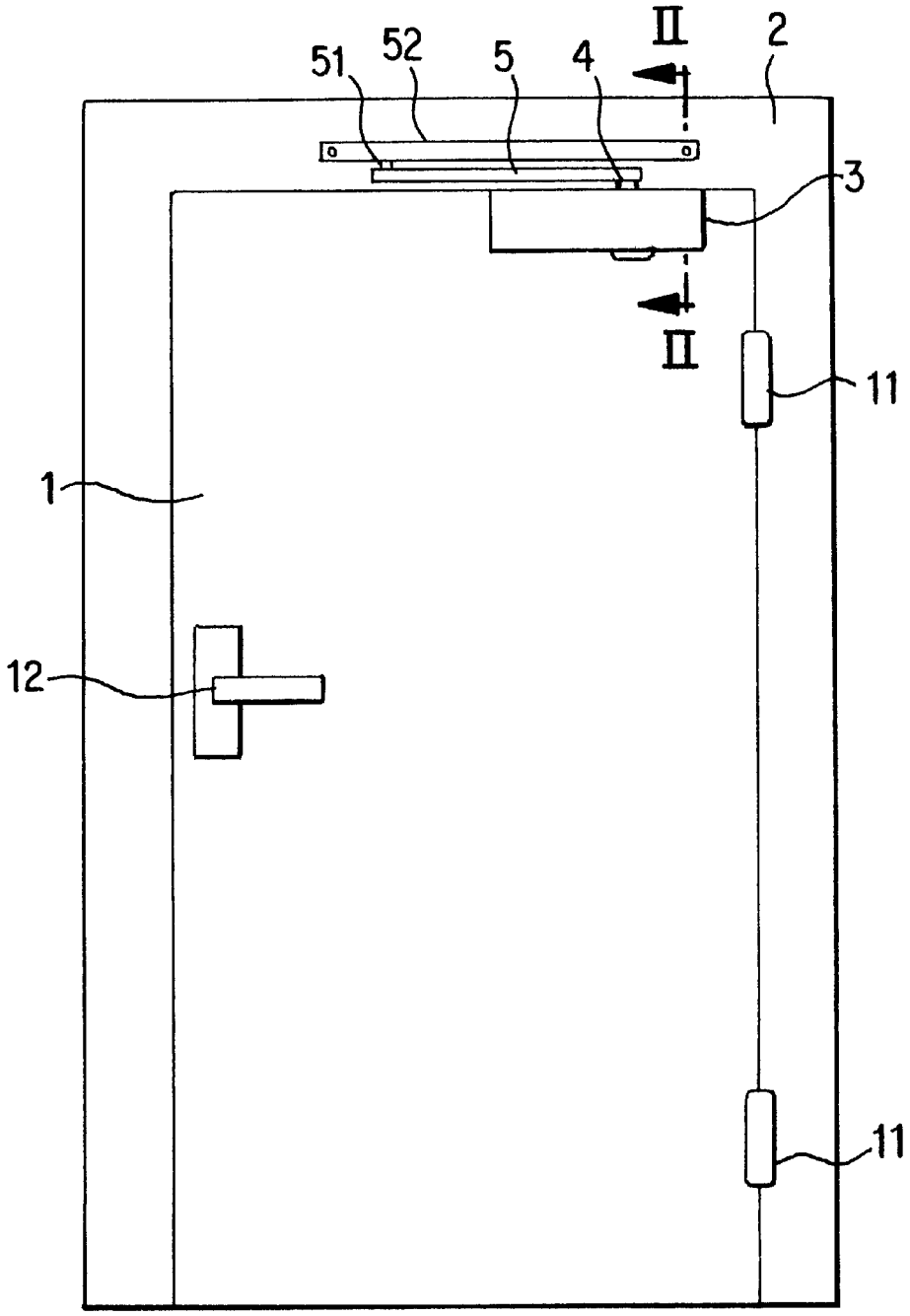
FIG. 1 is a schematic front elevation of an entrance with a flat-mounted sliding-arm door closer, FIG. 2 a longitudinal section through the door closer housing in FIG. 1, FIG. 3*a*) a cross section through the door closer housing, taken along line III—III in FIG. 2 in the area of the hydraulic passages, *b*) a cross section through a hydraulic passage, taken along line IIIb in FIG. 3*a*, FIG. 4 a cross section through the door closer housing, taken along line IV—IV in FIG. 2 in the area of the closer shaft, FIG. 5 a representation corresponding to FIG. 4 with the closer shaft installed, FIG. 6 a cross section through the door closer housing along line VI—VI in FIG. 2 in the area of the mounting bores, FIG. 7 a side view of the door closer housing in FIG. 1, FIG. 8 a longitudinal section through the door closer housing in FIG. 1, FIG. 9 a cross section through a door closer housing of an alternative embodiment, FIG. 10*a*) a cross section through a door closer housing of another embodiment, *b*) a cross section through a hydraulic passage, along line Xb in FIG. 10*a,*

FIG. 1 shows a schematic front elevation of a doorway. The door 1 is pivoted at a vertical edge in hinges 11 on the door frame 2. The door 1 is equipped with a flat-mounted sliding arm door closer 3.

The sliding arm door closer 3 consists of a door closer housing 31 in which a closer shaft 4 is mounted for rotation. A sliding arm 5 is fastened for co-rotation with the closer shaft 4 and has at its free end a slider 51 which is carried for displacement and rotation in a slide rail 52. In the door closer housing 31 there are a closing spring 7 represented in FIG. 8, and a damping device, which cooperate with the closer shaft 4. The sliding arm door closer 3 can be a conventionally constructed door closer 3, e.g., a hydraulic door closer such as described in DE 36 38 353 A1. Such a door closer 3 operates such that, when the door 1 is opened manually, the positive movement of the linkage 5 and of the closer shaft 4 thus produced, the closing spring 7 is compressed. The closing then is performed automatically by the action of closing spring 7, while hydraulic medium is exchanged between two piston working chambers.

In the kind of installation shown in FIG. 1, known as door-mounted installation, the door closer housing 31 is mounted on the door 1. In this case the slide rail 52 is mounted on the door frame 2. In another type of mounting that is not shown, known as head-mounted installation, the door closer housing 31 is mounted on the door frame 2 and the slide rail 52 on the door 1. Installation can be made either on the hinge side or on the side opposite the hinge.

In alternative embodiments, a scissors linkage can be used instead of a sliding arm linkage 5. Application of the invention is also possible on twin doors, which can additionally be equipped with a closing sequence control. Also possible is the use of the invention on electrohydraulic door closers which additionally have a hydraulic pump for motor-driven opening or motor-assisted opening of the door 1. The hydraulic pump is preferably also disposed in the housing 31 or connected to it. In the following figures the explanation of the various embodiments of the invention is based on the hydraulic door closer 3 already described.

Figure 2:
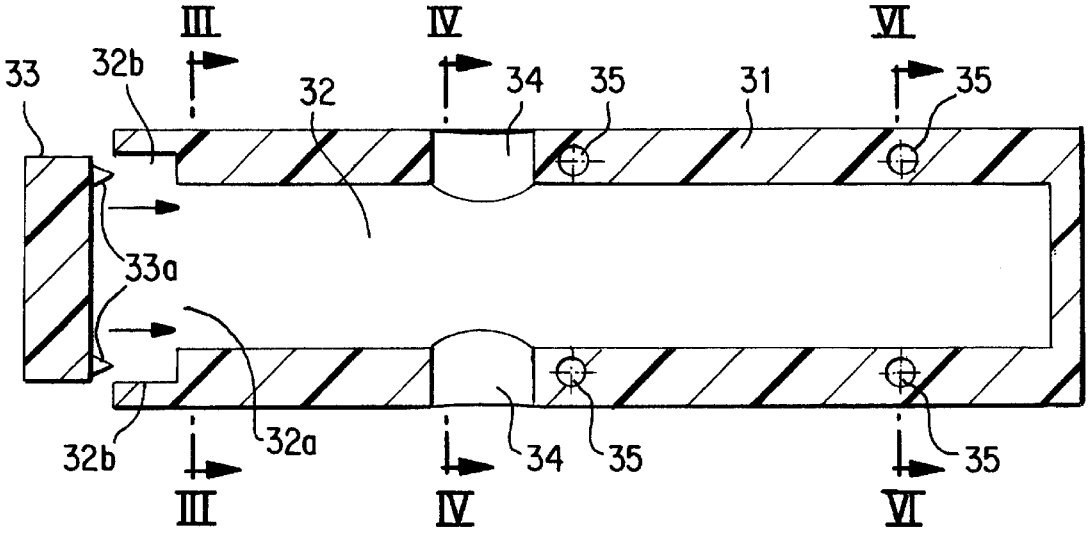

FIG. 2 shows a longitudinal section through an embodiment of a door closer housing 31 according to the invention. Inside of this housing 31 there is formed the cylinder chamber 32 which accommodates the piston 6 and the closing spring 7 shown in FIG. 8. The cylinder chamber 32 is open at its one end, and after installation of the piston 6 and closing spring 7 it is closed, by welding for example, with the disk-shaped end plug 33 represented separately in FIG. 2. Both the door closer housing 31 and the end plug 33 are made of plastic, preferably by injection molding.

The use of plastic offers various advantages which ultimately amount to a decided reduction of the cost of manufacture. Plastic parts can be injection-molded or cast with substantially less tolerance compared to metal parts. Thus, right in the manufacture of the raw housing a greater accuracy of fit can be achieved, which ultimately reduces the necessary finishing operations. It is also an advantage that most of the openings and bores in the housing can be created without machining operations right during the production of the housing 31 by the use of appropriate injection molding dies. This eliminates the drilling of holes afterward for mounting or for the hydraulic system. If nevertheless finishing operations should be necessary or desired, they can be performed much more easily than in a metal housing. Also, in the two-component injection molding process it is possible to work two different plastics in a single manufacturing process, if it is necessary, for example, to use plastics with especially good low-friction qualities or plastics with especially great strength. Plastics suitable for the manufacture of the door closer housing 31 are, for example, aromatized polyamides with a high content of glass fibers to increase strength. This material is also distinguished by low thermal expansion, which is advantageous to the accuracy of adjustment of the hydraulic valves.

The end plugs 33 do not have to be threaded into the housing as in the case of conventional metal housings, but can be affixed to the housing by ultrasonic welding. First the end plug 33 is inserted into the end of the housing 31 in a circular recess 32*b* whose diameter is greater than the diameter of the concentric cylinder chamber, where it covers the mouth of the cylinder chamber 32 since its diameter is greater than that of the cylinder chamber 32. With a bead 33*a* formed in the radially outer part of the plug face, the end plug 33 lies against the area of the housing surrounding the cylinder chamber 32. The bead 33*a* serves as an energy aiming means in ultrasonic welding. By a brief input of energy through ultrasonic waves the bead 33*a* and the adjacent housing area are briefly fused and thereby permanently welded together.

Alternative fastening methods which can likewise be used include solvent welding wherein both of the plastic parts are welded together by transient action of a solvent, or pinning with a number of small fastening pins which are set radially into the housing and enter into the plug 33.

In alternative embodiments the end plug 33 does not necessarily have to be placed on the piston end of the cylinder chamber 32. The opposite, closing-spring end of the cylinder chamber can be closed in that manner. Likewise, both ends of the cylinder chamber 32 can be closed by end plugs 33.

In modified embodiments, a cup-shaped housing part can be provided instead of the end plug 33, and can be bonded to the other housing part in appropriate manner.

Figure 4:
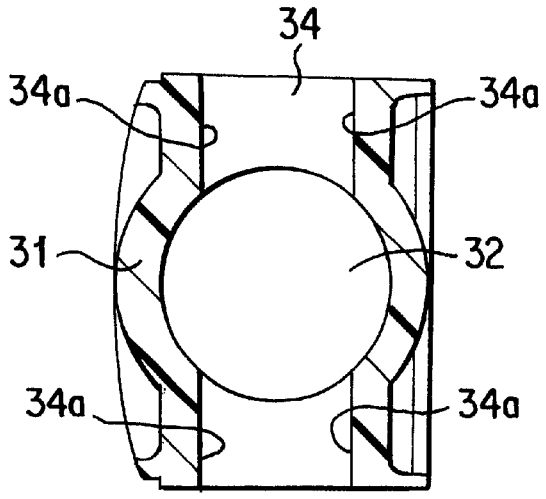
Figure 5:
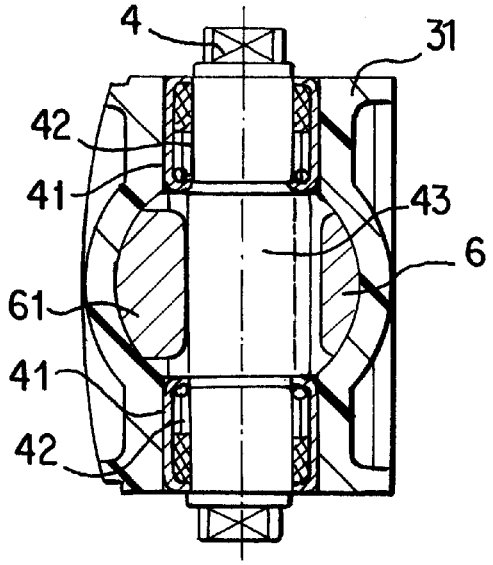

The housing 31 in FIG. 2 has in its center a transverse cylindrical opening 34 cutting through the cylinder chamber 32 to accommodate the closer shaft 4 represented in FIG. 5. The transverse opening 34 is formed in the housing 31 during manufacture of the latter, and does not have to be bored after it. In like manner, four mounting bores 35 passing through the housing 31 for mounting the door closer 3 on a door 1 or door frame 2 are formed in the housing 31 when the latter is produced. The transverse opening 34 and the mounting bores 35 are shown and explained in detail in FIGS. 4 to 6.

Figure 3A:
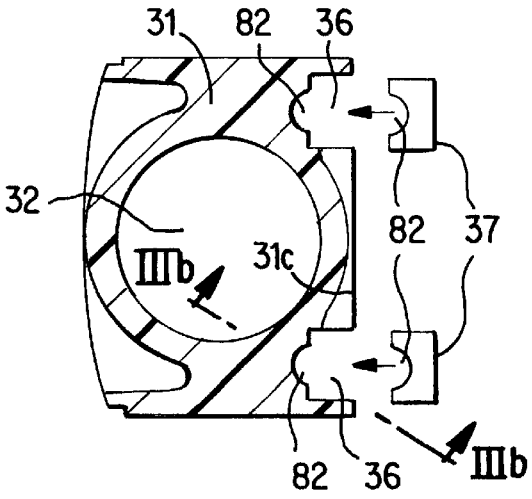

FIG. 3*a* shows how the hydraulic passages are formed without machining. A cross section along line III—III is represented in FIG. 2. On the bottom of the housing 31 (on the right in the figure) there are two elongated, rectangular-shaped recesses running from the end of the housing near its outside edges. In the bottom of each recess 36, one half of a longitudinal passage 82 is formed. The two recesses 36 can have different lengths, according to where the radial passages 81 branching off from them and represented in FIG. 3*b* open into the cylinder interior space.

Into the two recesses 36, separately made inserts 37 of plastic are inserted, in which the other half of the circular (for example) longitudinal passages 82 is formed. The insertion of the inserts 37 thus creates the longitudinal passages 82. The inserts 37 are welded or cemented to the housing 31 as already described in the case of end plug 33.

Figure 3B:
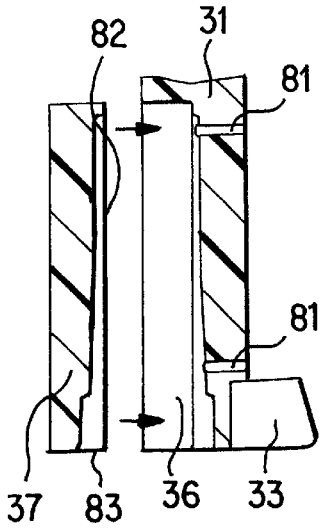

As seen in FIG. 3*b*, a radial passage 81 branches from both ends of each longitudinal passage 82 into the cylinder chamber 32. The hydraulic valve for establishing the closure damping or abutment, which is not shown in the figure, is inserted from the end of the longitudinal passage 82. The first radial passage 81 opens on the piston end of the cylinder chamber 32 in the area immediately before the end plug 33. The second radial passage 81 opens in the middle area of the cylinder chamber 32 or in the end area of the cylinder chamber 32 according to whether it is intended to adjust the closure damping or the abutment. The radial passages 81 are formed during the production of the housing 31 by means of appropriate injection molds and do not need to be bored afterward. Depending on requirements, however, it is also possible to bore the hydraulic passages into the housing 31 in a conventional manner.

FIG. 4 shows a section through the housing 31 in the area of the transverse bore 34 for the closer shaft 4. Annular sealing beads 34*a* are formed on the inner wall of the transverse bore 34 on both sides of the cylinder chamber 32. These sealing beads 34*a* also consist of plastic and are placed in the transverse bore 34 by the two-component injection molding process during the production of the housing 31. By their sealing action the sealing beads 34*a* prevent the escape of hydraulic oil from the cylinder chamber 32. In the case of special designs, the sealing beads 34*a* can be configured as slide bearings for the closer shaft 4 which is not represented.

An alternative possibility for mounting the closer shaft 4 is shown in FIG. 5. The sealing is in this case by cementing a needle bearing sleeve 41 of plastic or metal or ceramic into the transverse opening 34. Inside of the cylinder chamber 32 can be seen the piston 6 and the pinion 43 meshing with the rack 61.

Figure 13:
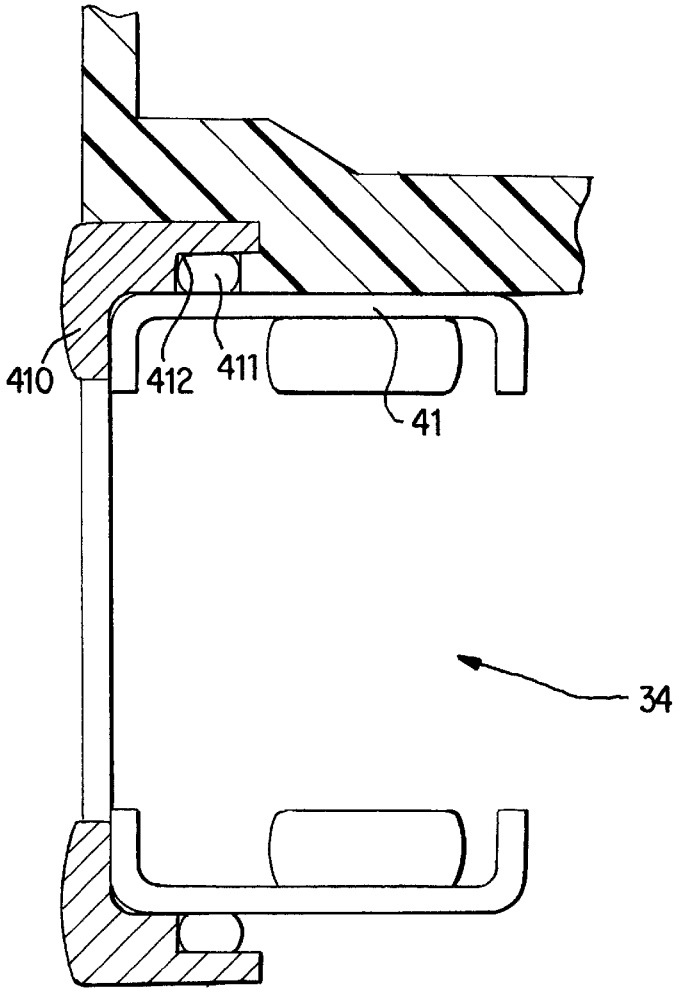

In an embodiment different from FIG. 4, represented in FIG. 13 the needle bearing 41 is sealed by a separate ring 410 with a sealing ring 411. To accommodate the needle bearing 41 and the ring 410 the transverse opening 34 is configured in the manner of a stepped bore, the greater diameter being formed at the outer axial end of the transverse opening 34 and the smaller diameter being formed in the section opening into the cylinder chamber 32. The needle bearing 41 is inserted with the needle bearing sleeve into the section of smaller diameter and cemented therein, and extends with about one-third of its axial length into the area of larger diameter. The ring 410 is inserted into the transverse opening 34 in the area of larger diameter to abut against the radial step of the transverse opening 34. The ring 410 has a first axial section with an inwardly pointing rim and a second axial section of sleeve-like configuration and has at its end a step-shaped recess 412 in its inner wall. The ring 410 is inserted into the transverse opening 34 in the area of the greater diameter such that the end surface of the sleeve-like end abuts against the radial step of the recess 34, and the sleeve-like section of ring 410 is fitted between the inner wall of the transverse opening 34 and the outer wall of the section of the needle sleeve 41 reaching into this area. The radial recess 412 formed in the sleeve-like section of ring 410 forms in this situation an undercut groove of substantially U-shaped cross section. The sealing ring 411 is held in this groove.

With the sealing ring 411 in the undercut groove a good sealing of the needle bearing 41 is obtained. The undercut groove 412 in which the sealing ring 411 is disposed is formed by means of the separate ring 410 without the need to form an undercut groove in the opening 34 in the injection molding procedure. In the case of injection molding, such an undercut would require a complicated mold. The ring 410 can be made of plastic or metal. It can be glued in, but also welded in by ultrasound.

Instead of a needle bearing 41 a ball bearing or other separate bearing can be used and sealed in the same or a similar manner with a separate ring. Such a seal by a separate ring or the like can be made also in the case of other components mounted in the housing, e.g, for sealing valves or for sealing the housing cover.

Figure 6:
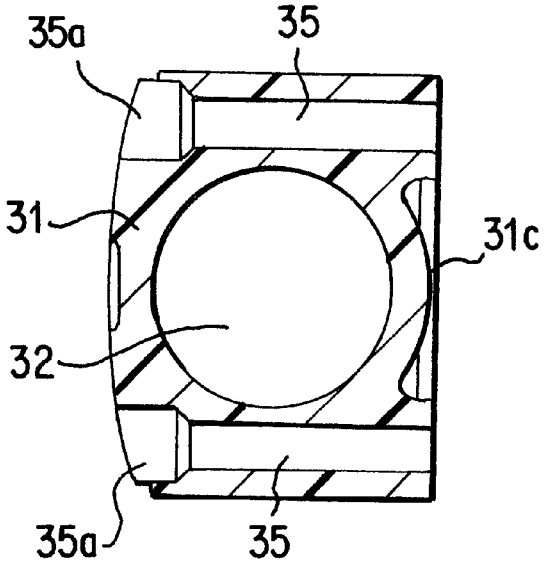

FIG. 6 shows a cross section in the area of the mounting bores 35. The mounting bores 35 are formed on both sides of the cylinder chamber when the door closer housing is injection molded. Thus no machining of the housing 31 is necessary after it has been molded. The mounting bores 35 run from the slightly curved front side to the rear side of the housing 31, the bores having a countersink in a front-end section 35*a* to accommodate the screw heads.

Figure 7:
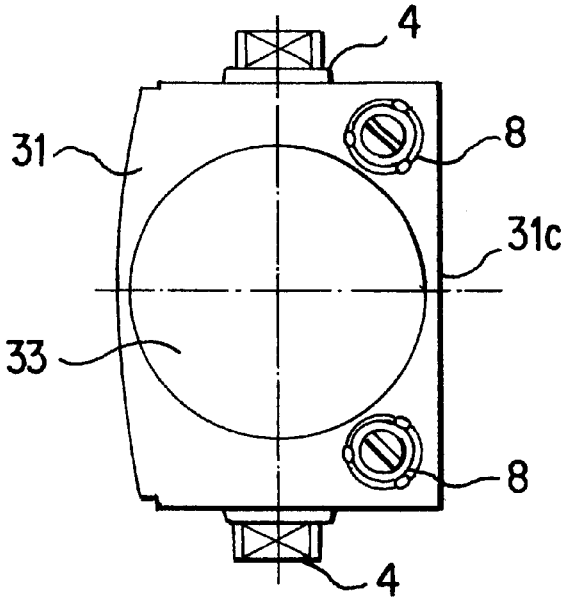

FIG. 7 represents a side view of the door closer 3 when closed by an end plug 33 and provided with valves 8. One valve serves to regulate the damping action and another serves to adjust the final closing.

Figure 8:
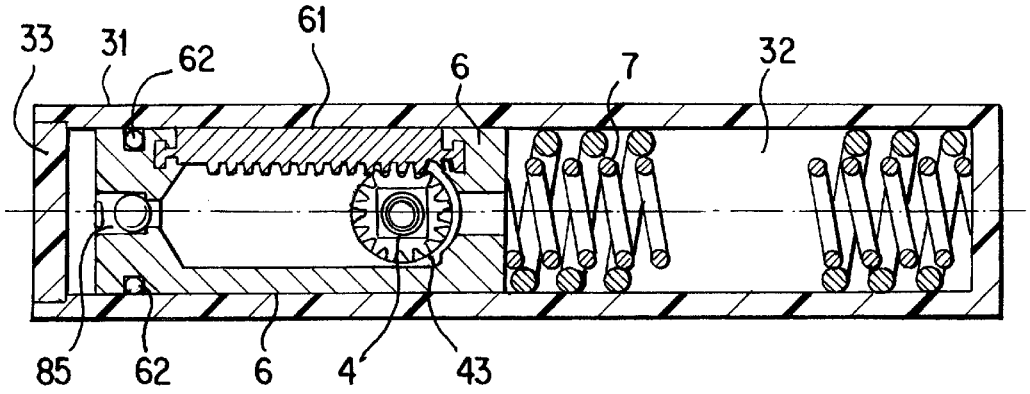

FIG. 8 shows a longitudinal section through a door closer housing 31 in the area of a piston 6 made of a plastic and metal composite. The basic body of the piston 6 is made of plastic. This results in immediately improved friction properties in the cylinder chamber 32. Moreover, the recesses for the sealing ring 62, or the passages for the check valve 85 are already formed in the piston 6 when the latter is molded. The cost of manufacture is considerably reduced by the elimination of machining operations. The rack 61 made of metal is loosely placed inside of the injection-molded plastic piston 6, or cemented or fastened therein by a suitable method. In like manner the closer shaft 4 can also be made of a plastic and metal composite material. Alternatively it is possible to make the pinion 43 and/or the piston 6 of metal.

Furthermore it is possible to make these components as well as the closer shaft 4 entirely of plastic, preferably of plastics of high compressive strength.

Figure 9:
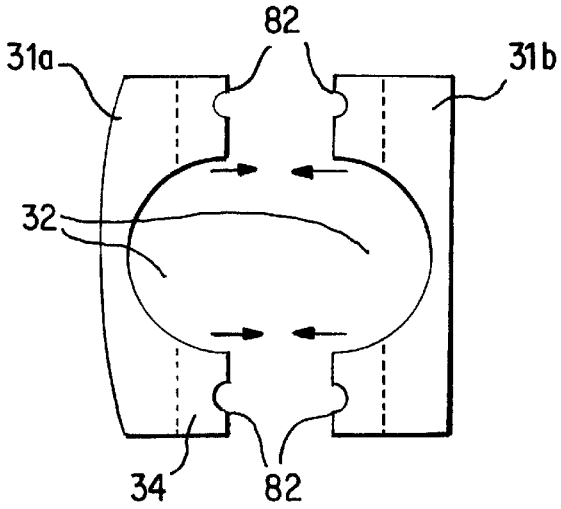

In FIG. 9 the schematic cross section of an alternative embodiment is shown. The housing is composed of two separately made plastic halves 31*a*, 31*b*. The longitudinal passages 82 lie in the plane of section and are formed half on each side of the cylinder chamber 32 in each half 31*a*, 31*b*. The housing halves 31*a*, 31*b*, can be assembled together along the longitudinal axis of the housing, i.e., the plane of separation or section runs lengthwise of the housing.

Figure 10A:
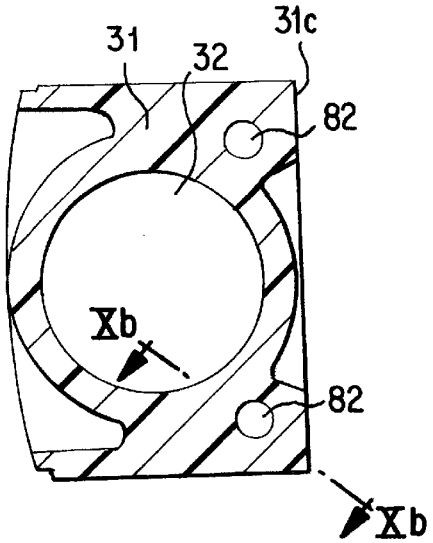
Figure 10B:
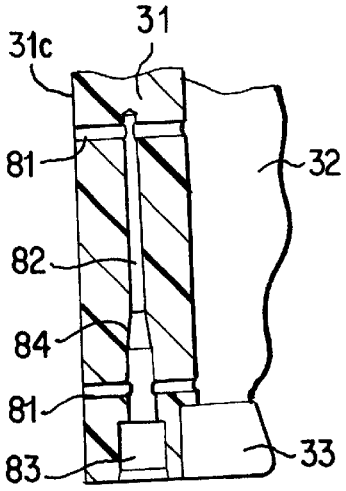

FIG. 10 shows another embodiment in which the longitudinal passages 82 are formed in the housing 31 when the latter is made. In this embodiment separate inserts 37 are not used. To be able to form also the radial passages 81 when the housing 31 is molded instead of by machining they are formed as shown in FIG. 10*b* by-leading them into the longitudinal passage 82 and out to the bottom 31*c* of the housing. This is necessary, since the injection molding tools enter from the outside. The radial passages 81 are afterwards sealed at the bottom 31*c* of the housing.

Figure 11:
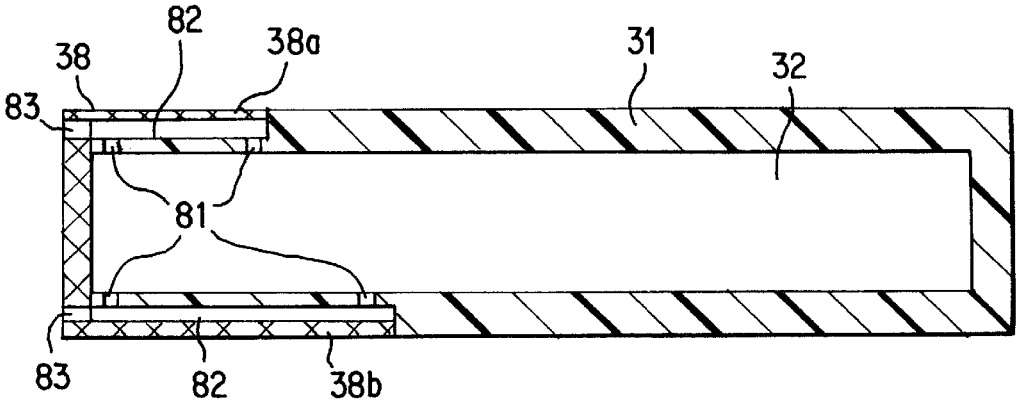
FIG. 11 a longitudinal section through a door closer housing according to a next embodiment, FIG. 12 a longitudinal section through a door closer housing composed of two halves, FIG. 13 a representation like FIG. 5 of a modified embodiment in which the needle bearing is fastened with a ring.

FIG. 11 shows another embodiment in longitudinal section. In this embodiment the cylinder chamber 32 is not closed by an end plug 33 but by an end cap 38 of U-shaped cross section, the end cap 38 being cupped around the housing 31 with the formation of longitudinal passages 82. The end cap 38 has a first short marginal section 38*b* and a second, longer marginal section 38*b*. So it can be of a cup-like configuration with marginal sections 38*a*, 38*b*, of different length around its circumference. In the area of these marginal sections 38*a*, 38*b*, the end cap 38 overlaps the housing 31 and the cylinder chamber 32. A gap remains between the insides of the marginal sections 38*a*, 38*b*, and the outside of the housing 31 and serves as a longitudinal passage 82. The radial passages 81 leading into this gap are already formed when the housing 31 is made. As also already described in the case of the end plug 33, the end cap 38 is also welded to the housing 31. In this embodiment separate inserts 37 to form the longitudinal channels 82 are no longer necessary.

Figure 12:
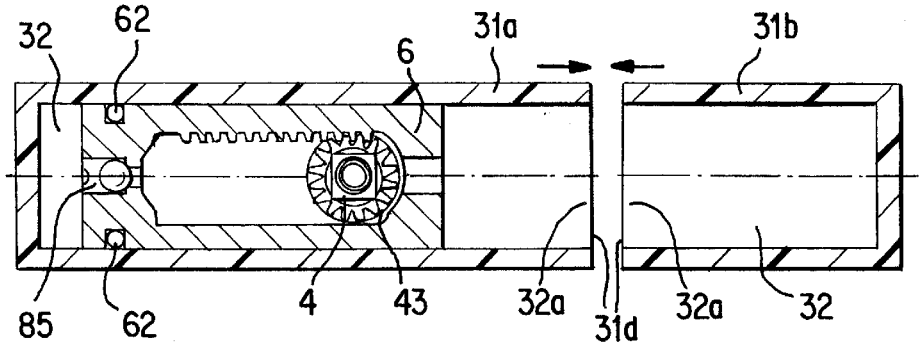

An additional variant embodiment with a cylinder chamber 32 consisting of two halves 31*a*, 31*b*, is shown in FIG. 12. The housing halves 31*a*, 31*b*, can be put together in a plane across the longitudinal axis of the housing, i.e., the plane of the seam or section runs transversely across the housing.

In a first half 31*a* formed in the axial direction of the cylinder 32 the piston is guided for axial displacement as in the embodiment in FIG. 8. This first cylinder half 31*a*has no cylinder cover but only a cylinder opening 32*a* against which the second cylinder half 31*b* is placed with its corresponding cylinder opening 32*a*. In the second cylinder half 31*b*, which is cup-shaped as is cylinder half 31*a*, the spring, not shown, is contained with its essential length. In contrast to FIG. 11 the cylinder halves 31*a*, 31*b*, do not overlap one another but form a seam 31*d* as a plane of section in which they are welded or cemented together. The position of the seam 31*d* is chosen such that the piston 6 does not come in contact with the seam 31*d* in any of the piston's possible positions, and the seam 31*d* is situated exclusively within the spring chamber.

The use of the invention is not limited to the door closer 3 represented. Basically its use is advantageous where metal housings are used in door closers on doors, windows, smoke exhaust openings, light cupolas and the like, which heretofore have had to be expensively made by machining for their purpose.

What is claimed is:

1. A closer for a door, comprising:

a housing comprising at least one bore chamber, wherein at least one section of the housing is made of plastic;

a restoring device, disposed in the housing, which is charged upon movement of the door and serves as an energy accumulator for automatic closing of the door;

a damping device disposed in the housing for damping at least one of closing or opening movement of the door;

an output member, received in the housing, on which the restoring device acts, a force-transmitting linkage that is supported at one end in a rotary or sliding bearing and at the other end is connected to the output member, and inserts received in recesses defined in the housing so as to define passages communicating with said at least one bore chamber for permitting passage of fluid thereby controlling movement of said door.

2. A closer according to claim 1, wherein the restoring device is a closing spring.

3. A closer according to claim 2, wherein at least one of the output member, a damping piston of the damping device, and the closing spring are received in the at least one bore chamber, and wherein the at least one bore chamber is configured at least section-wise without machining or is preformed between a plurality of housing parts made of plastic without machining.

4. A closer according to claim 3, wherein the piston comprises plastic, metal, or ceramic.

5. A closer according to claim 4, wherein the piston comprises a plastic-metal composite material or a plastic-ceramic composite material.

6. A closer according to claim 3, wherein at least one of the output member, a rack, or an output pinion is made from plastic, ceramic, a plastic-metal composite material, or plastic-ceramic composite material.

7. A closer according to claim 6, wherein the rack is a separate part and is laid, clipped, cemented, welded or injected into the piston.

8. A method for the manufacture of a closer for a door, the closer including a door closer housing, comprising: providing a restoring device, disposed in the door closer housing, that is charged upon the movement of the door and is configured as an energy accumulator for automatic closing of the door, providing a damping device disposed in the door closer housing for damping closing or opening of the door, providing an output member, received in the door closer housing, on which the restoring device acts, providing a force-transmitting linkage which is supported at one end in a rotary or a sliding bearing and at the other end is connected to the output member, and, assembling a plurality of plastic housing parts without machining to form the door closer housing, forming at least one bore chamber in which at least one of the output member, a damping piston, and a closing spring can be received.

9. A closer according to claim 1, wherein the damping device is a hydraulic damping device.

10. A closer according to claim 1, wherein the output member is an output shaft.

11. A closer according to claim 10, further comprising a shaft bearing for the output shaft cemented or welded in a corresponding opening in the housing.

12. A closer according to claim 11, wherein the shaft bearing is a molded plastic part.

13. A closer according to claim 11, wherein the shaft bearing is configured as a needle bearing or ball bearing formed from a ceramic.

14. A closer according to claim 11, further comprising a separate ring disposed in a recess for receiving the shaft bearing, wherein the separate ring comprises plastic, metal, or ceramic.

15. A closer according to claim 14, wherein the separate ring is adapted to receive a separate gasket.

16. A closer according to claim 15, wherein the separate gasket is configured as a sealing ring which is disposed in a recess of the separate ring.

17. A closer according to claim 15, wherein the separate ring forms, together with a radial step in the recess, an undercut groove in which the separate gasket is received.

18. A closer according to claim 1, wherein the bore chamber accommodates the closing spring, and wherein the housing comprises at least two housing parts, each housing part defining a part cut in the axial direction of the cylinder chamber or a part cut transversely of the cylinder chamber.

19. A closer according to claim 18, wherein the cylinder chamber is closable at one or both ends by a separately made end plug.

20. A closer according to claim 19, wherein the end plug is disk-shaped.

21. A closer according to claim 1, wherein the plastic is a fiber-reinforced plastic.

22. A closer according to claim 21, wherein the fiber-reinforced plastic is a glass fiber-reinforced or carbon fiber-reinforced plastic.

23. A closer according to claim 1, wherein the housing is formed without machining.

24. A closer according to claim 1, wherein the housing comprises a plurality of separate adjoining sections fixed together by cementing or welding.

25. A closer according to claim 1, wherein the housing comprises a plurality of separate adjoining sections fixed together by fastening pins or screws.

26. A closer according to claim 1, wherein the at least one bore chamber is defined by sections of adjoining separately made housing parts without machining.

27. A closer according to claim 1, wherein a plurality of parts of said housing are made of plastic.

28. A closer according to claim 1, wherein the at least one bore chamber is closable at least at one end by a separately made end cap having a margin passing around the at least one bore chamber.

29. A closer according to claim 28, wherein the passages are formed without machining.

30. A closer according to claim 29, wherein the passages lead into the at least one bore chamber.

31. A closer according to claim 1, wherein the recesses are formed without machining or preformed without machining.

32. A closer according to claim 31, wherein at least one passage section is open to an end face, a front face, a top face, or a bottom of the housing.

33. A closer according to claim 31, wherein at least one passage section is a valve passage section.

34. A closer according to claim 1, wherein one or more housing parts comprise formed-on, welded-on, or cemented-on mounting feet for fastening to a door or a door frame, and wherein at least one hole is formed without machining or preformed without machining for receiving a fastening element.

35. A closer according to claim 1, wherein the housing comprises bores formed without machining that pass through the housing for fastening screws for fastening to the door or a door frame.

36. A method according to claim 8, wherein assembling the plurality of plastic housing parts comprises cementing or welding.

37. A method according to claim 8, wherein forming the at least one bore chamber comprises assembling at least two housing parts, and wherein each of said at least two housing parts has a cylinder section and is formed as a part cut in the axial direction of the cylinder or as a part cut transversely of the cylinder, and wherein the at least one bore chamber is a cylinder bore for receiving the damping piston.

38. A method according to claim 8, wherein the housing is made from fiber-reinforced plastic.

39. A method according to claim 8, wherein the door closer housing comprises a plurality of bore chambers, wherein one bore chamber is configured as a cylinder chamber to receive a piston of the damping device or the closing spring, and a second bore chamber is configured as a passage of the damping device, which is configured as a separate housing passage and leads into the cylinder chamber, and wherein the housing passage is preformed without machining or at least preformed without machining at least section-wise during injection molding of the door closer housing with a mold core.

* * * * *